US007631368B1

(12) United States Patent
Samson

(10) Patent No.: US 7,631,368 B1
(45) Date of Patent: Dec. 15, 2009

(54) COMBINED CONCEALED CARRY HOLSTER UNDERGARMENT AND OUTERGARMENT WITH QUICK RELEASE AND QUICK ACCESS MECHANISMS

(76) Inventor: Allan Samson, 39 Lee Hill Rd., Andover, NJ (US) 07821

( * ) Notice: Subject to any disclaimer, the term of this patent is extended or adjusted under 35 U.S.C. 154(b) by 1218 days.

(21) Appl. No.: 10/915,587

(22) Filed: Aug. 11, 2004

Related U.S. Application Data

(60) Provisional application No. 60/544,077, filed on Feb. 13, 2004, provisional application No. 60/472,397, filed on May 22, 2003.

(51) Int. Cl.
*A41D 27/20* (2006.01)

(52) U.S. Cl. ..... 2/247; 2/51; 2/77; 2/94; 2/115

(58) Field of Classification Search ..... 2/247, 2/51, 77, 94, 95, 115, 250, 253
See application file for complete search history.

(56) References Cited

U.S. PATENT DOCUMENTS 5,832,536 A * 11/1998 Kramer ..... 2/69
6,695,186 B2 * 2/2004 Madarang ..... 224/587
7,058,987 B2 * 6/2006 Salazar ..... 2/247

* cited by examiner

*Primary Examiner*—Gary L Welch
*Assistant Examiner*—Alissa J Tompkins

(57) ABSTRACT

A universal compression undergarment holster apparatus, pant/shorts and shirts worn under a users clothing for the concealment and simultaneous carry of more then two weapons and other items such as handcuffs, extra ammunitions, batons, flashlights, knives, radios, pen, and the process that permits for weapons and or other items located in the apparatus to be safely carried and quickly drawn from the users outer clothing from over 12 conventional modes on the human body, such as but not limited to under the arm on either side thereof, on the chest thereof, on either leg thereof, on the back thereof, on either waist thereof, also having a safety straps integrated with a quick release mechanism. The holster system covering the upper and lower body and includes an integral holsters/pouches stitched and fastened using alternative fasteners to secure the hostlers pouch to the under garment having a receiving pockets, and an outer accessible garment with quick access detachable fasteners features, that is comfortable and convenient for the wearer and conceal from view the weapon located in the undergarment holster apparatus in a secure but in a quick and easy accessible locations on the body, unknown to any even the most careful observe.

1 Claim, 6 Drawing Sheets

COMBINED CONCEALED CARRY HOLSTER UNDERGARMENT AND OUTERGARMENT WITH QUICK RELEASE AND QUICK ACCESS MECHANISMS

CROSS REFERENCE TO RELATED APPLICATIONS

This application is based on provisional application 60/472,397 filed May 22, 2003, and 60/544,077 filed Feb. 13, 2004.

BACKGROUND OF THE INVENTION

This invention relates generally to the field of conceal carry of a weapon and other items and more specifically to a universal compression shirt and short undergarment apparatus (holster/pouch) worn under one's outer-clothing, for the concealment and simultaneous carry of more then two weapon(s) and or other items under each arm and legs, and the process that permits for weapon(s) and or other items located in said apparatus to be safely carried and quickly drawn from the wearers outer clothing (Quick Access Dress Shirt/Pants) from over 12 conventional modes on the human body (under the arm on either side thereof, on the chest thereof, on either leg thereof, on the back thereof, on either waist thereof), without the need of special and or additional fixtures, said concealment apparatus having a safety strap(s) integrated with a quick release mechanism to keep said items in place and resist inadvertent removal and or slipping out of said holster/pouch, until removed by the wearer.

This invention relates to an improved universal wearable conceal carry under garment holster system which can be converted to allow for the total conceal carry of handguns, handcuffs, batons, flashlights extra ammunition, radios and other related items in any one of the multiple distinct modes of carry at any desired location on the body, such as but no limited to being worn on the wearers chest, under either armpit, on the wearers waist, below the waist on either leg and or on the lower back of the wearer. This invention also relates to the mode and process that makes it possible to safely and rapidly utilize the undergarment holster system, in which the wearer of the under garment will access the weapon and other items located in the holster from an outer clothing garment due to the outer clothing shirt and or pants quick release snap button and or Velcro fasteners.

In the world post Sep. 11, 2001, the need for law enforcement, security professionals and others with conceal carry permits to carry their weapons in a concealed fashion has greatly increased. Today some if not most law enforcement agencies mandates that those officers in first responder positions carry their weapon(s) when they are off duty, these individuals must do so and without alarming the public that they are armed. Law enforcement professionals and those in the need to carry conceal weapons and other concealable items, such as handguns, handcuffs, extra ammunitions, knives and other such items are faced with the dilemma in that the holsters and or other apparatus available for use are designed for use either inside their clothing with limited access and or outside of the wearers clothing where it is visible for all to see, or for left and right hand access, but not ambidextrous to allow both right or left hand access. With that, it is necessary that the wearer must buy a variety of holsters and or other concealment apparatus to fit different conditions and situations, which can prove to be very costly.

There have been a variety of holsters provided in the prior art some of which have been presented as being universal but none of them provides the versatility, functionality and uniqueness that our holster system provides. It is the intent of our invention to provide a universal and multifunctional, undetected concealable holster system, which that allows for the conceal carry and quick access of a weapon and other items from the wearers body most notably the upper and lower torso combined, and to be worn comfortably. Although some holster assemblies can be utilized in one or even two modes of carry, none of these devices provides, the multi-functionality for the secure and safe retention of a handgun and other items in each one of the well known and accepted concealed carrying positions, as well as the means to quickly access the weapon from an outer concealment garment.

Unlike the prior arts this invention provides the method and process that permits an uninterrupted quick and easy access from the wearers outer clothing to the gun and other items located in the under garment holster system within seconds, so that in a crucial situation (s) such as a draw by a law enforcement officer, will be quick and unobtrusive. This is done through a movement(s) that enables the wearer from his or her outer garment to remove the weapon from the holster with a natural sweeping motion of the hand/arm without having to contort or unnaturally position the body. This invention allows the complete carry of multiple concealed weapon (Handguns) and other essential items such as handcuffs, extra ammunitions, a small baton, and knife with no restrictions on the type of clothing that can be worn. The holster system is completely independent of the clothing worn, and can be worn in all types of environments and climates (winter, spring, summer and fall). Another very important aspect to this invention is that it can be worn by all body type's sizes and shapes, and will not restrict body movement and or access.

Prior art known to the inventor includes U.S. Pat. No. 5,832,536 which discloses a undergarment pullover-type shirt holster, it is not describe as being multi-functional, and as the present invention, but it does have similarities to the present invention, although of similar design to the current invention, it does not have firearm pockets of the correct shapes designed for fast quick snap access's when drawing the firearm from various positions, upward side-ward, downwards. It also does not allow for the carry of more then two handguns, handcuffs, extra magazines, small collapsible baton under each arm on either side, on the chest, on either leg, on the back, on either waist, without impeding the speed of retrieving the weapon, with our current invention there is no need to include and or attach shoulder straps to support and or hold the gun(s) and or other items placed in the holster/pouch, as the weight of the gun(s) and other item placed inside the holster/pouch is supported by the garment itself made of fiber-reinforced polymers and the like material, and due to the fact that the holster is stitched and reinforced and secured with snap fasteners on the garments.

U.S. Pat. No. 2,951,622, this holster, however, is limited as to the locations where it can be worn, and cannot be worn inside a trouser leg.

U.S. Pat. No. 4,270,680, Shows a design for concealment and which utilize structure adapted for wearing inside the trousers of the wearer.

U.S. Pat. No. 2,819,830, Shows a holster not adapted to be worn inside a coat or jacket or inside a trouser leg or to be used by both right and left handed wearers.

U.S. Pat. No. 3,227,336, Shows a handgun holster that is worn inside the lower outer garment.

U.S. Design Pat. No. 234,840, Shows a garment vest-like for the carry of a weapon in a holster, handcuffs and extra cartridges.

U.S. Pat. No. 837,156 shows a belt carried holster, which has no teaching of a shoulder holster nor of a lower leg carried holster.

U.S. Pat. No. 4,084,734, shows a combined shoulder and belt holster.

U.S. Pat. No. 4,903,874 Shows a shoulder holster to include interconnecting straps.

U.S. Pat. No. 4,258,871, Shows a holster that may be worn inside the lower trousers leg as an ankle holster or under the armpit as a shoulder holster.

U.S. Pat. No. D. 333,570 Shows a supporting strap for around the waist use and contains two pouches for the transportation of beverages.

BRIEF SUMMARY OF THE INVENTION

The primary advantage of the invention is to provide a conceal carry holster system (shirt and short) combined undergarment and an outer accessible garment that is comfortable and convenient for a wearer and that combined maintains a weapon and or other items secure, and accessible from over 12 conventional conceal carry modes on the human body under the arm on either side thereof, on the chest thereof, on either leg thereof, on the back thereof, on either waist thereof and unknown to any even the most careful observer. Another advantage of the invention is to provide a new and improved process for law enforcement and for those with conceal carry permits to properly and effectively conceal the fact that they are armed by providing total and complete undetectable concealment under garment worn on the body, most notably the upper torso and lower torso above the knees.

Another advantage of the invention is to provide an undetected concealment holster that is easy to access from under the users clothing, and to provide the mechanism to do so. A further advantage of the invention is to provide a universal concealment holster system that will accommodate a variety of weapons, brands, sizes and lengths. Yet another advantage of the invention is to provide a holster system that allows the wearer with the ability to carry more then two guns at one time plus spare ammunitions in a comfortable concealable fashion without having to sacrifice conditioned draw reflexes and undetected concealment. Still yet another advantage of the invention is to provide a concealment shirt and short holster system that incorporates multiple convertible, detachable holster and pouches with ease of installation, adjustability and resolvability, that will retain a gun under strenuous activities, and will not sag or snag when the firearm and other items such as hand cuff, extra ammunitions, flashlight and a collapsible baton is place within the various pouches/holsters.

Yet another advantage of the invention is to provide a conceal carry holster system garment manufactured of Aramid and Para-Aramid fibers and fiber-reinforced polymers and the like material which protects the wearer against sudden unexpected attacks by a blunt trauma object or projectile, and capable of protecting its user from cut and slashes hazards and is fire retardant. Another advantage of the invention is to provide a mechanism to quickly access the firearm while wearing other clothing garments on top of the concealment shirt holster system. Yet another advantage of the invention is to provide an undercover comfort conceal carry compression shirt/short holster system, structure combining lightness, strength and convenience of construction. Another advantage of the invention is to provide a new and improved retention or tension method for a holster, which will reduce the inadvertent or unauthorized removal of weapon and or other items from the Under Cover Comfort compression holster system. Another advantage of the invention is to provide a quick release holster system that will withstand repeated actuation and will not deteriorate over time with usage. Yet another advantage of the invention is to provide a concealable holster that can carry a varied brand, sizes and style of weapons on the body without impeding the wearers ability to remove a weapon from the holster yet comfortable to wear and multi-functional. Another advantage of the invention is to provide a safety enhancing apparatus for use by undercover law enforcement professionals and others which enables the user to have readily available and accessible all of his/her issued equipments and tools in a conceal manner, and quickly accessible during an emergency situation.

In accordance with a preferred embodiment of the invention, there is disclosed a universal compression undergarment holster apparatus, worn under other clothing shirts, shorts or pants, for the concealment and simultaneous carry of more then two weapon(s) and or other items, and the process mechanism that permits for weapon(s) and or other items located in said apparatus to be safely carried and quickly drawn from the wearers outer clothing (Quick Access dress Shirt and Pants) from over 12 conventional conceal carry modes on the human body (under the arm on either side thereof, on the chest thereof, on either leg thereof, on the back thereof, on either waist thereof), without the need of special and or additional fixtures, this concealment apparatus having a safety straps integrated with a quick release mechanism to keep all items in place and resist inadvertent removal and or slipping out of the holster/pouch, until removed by the wearer of the apparatus comprising:

A combined concealment undergarment shirt holster system and an outer accessible garment with quick access features, that is comfortable and convenient for the wearer and maintains a weapon and or other items located in the holster in a secure but a quick and easy accessible location more specifically an undergarment(s) holster/pouch which is adapted for wearing above below the waist such as a T-shirt and below the waist such as short without sagging from the weight of a fully loaded weapon and the weight of other items in said holster/pouch; said undergarment concealment holster system having a quick release and detachable retention device, made of soft material which has a retention device for applying pressure to a handgun in the holster undergarment to resist inadvertent removal of the handgun and or other items located in said holster/pouch; said undergarment (tee-shirt and shorts) holster system covering a majority of the upper and lower body, removably securing a weapon having an opening pockets to receive a handgun and removably retaining a fully loaded hand gun, which includes an integral holsters/pouches stitched and fastened using alternative fasteners to secure the hostlers pouch to the undergarment; said pockets located on the upper leg, lower waist, chest, and capable of being used to carry a weapon (handgun various brands sizes, styles and shapes) and other items, such as but not limited to handcuffs, extra ammunitions, said garment also having an interior and exterior pouches for the insert of ballistic panels batons, flashlights, knives, gloves, cellular telephone, radios, pen and other similar items simultaneously and undetected; said pockets having a center core locking mechanism to support the weapon, said mechanism can be stitched horizontally, in circular, Z shape, and or snapped locked, comprising of a releasable fastening mode Velcro hook and loop and or snaps and or other alternative detachable fastening modes, to allow for the detachable closures of the top and bottom opening of the holster pouch pockets; fastening means separable by movement of the wearers on drawing of the weapon from the holster; said pockets partially stitched and detachable with a snap closure to allow for a side release, upward, frontward and downward draw of a weapon from said holster/pouch; said pockets capable of being transformed to carry other items such as handcuffs, gloves, extra ammunition (et, al), and is unknown to any even the most careful observer.

Other objects and advantages will become apparent from the following descriptions, taken in connection with the accompanying drawings, wherein, by way of illustration and example, an embodiment of the present invention is disclosed.

BRIEF DESCRIPTION OF THE SEVERAL DRAWINGS

The drawings constitute a part of this specification and include exemplary embodiments to the invention, which may be embodied in various forms. It is to be understood that in some instances various aspects of the invention may be show exaggerated or enlarged to facilitate an understanding of the invention.

Figure 11:
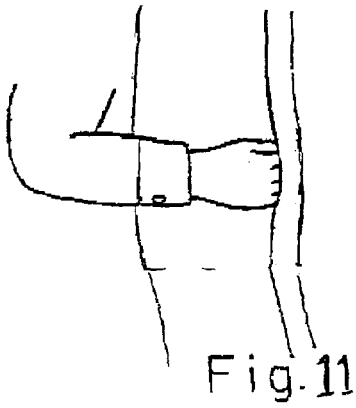

FIG. 11 modified view of a pans and or short worn over an undergarment, showing the wearer pushing his/her hand into the outer pants/short side seems access point to gain access to his/her weapons and or items securely located on his/her legs inside the undergarment concealment holster system.

Figure 12:
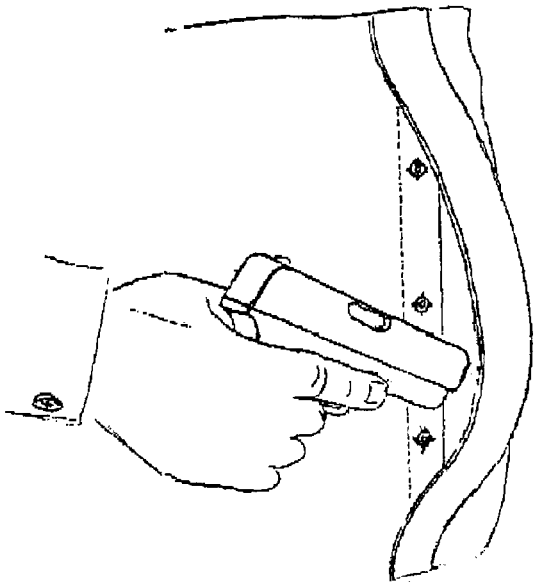

FIG. 12 is a fragmented view of a weapon being drawn from the quick snap button opening from the side of the pants/shorts.

Figure 13:
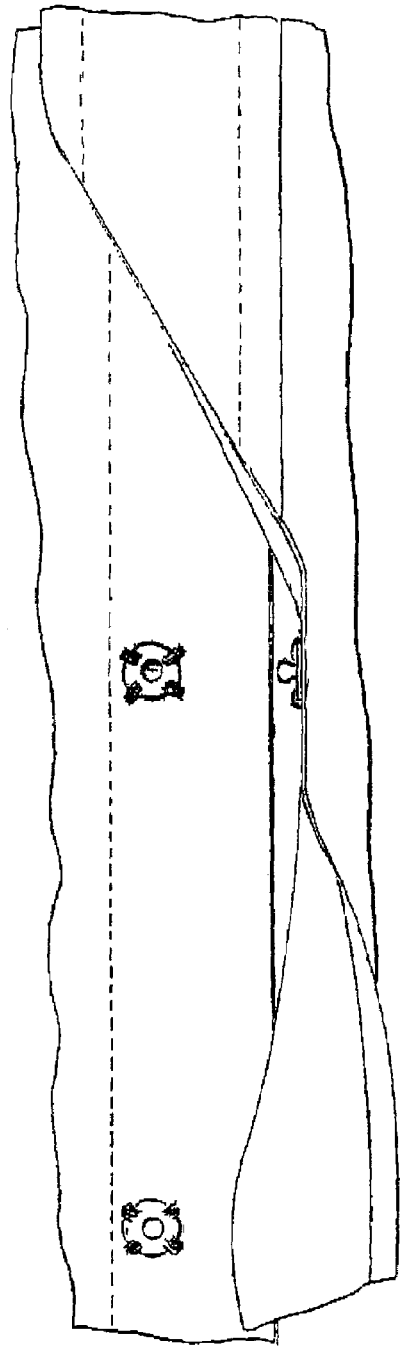

FIG. 13 is a fragmented close up view of the quick snap buttons opening of the outerwear pants/shorts worn over the undergarment.

Figure 14:
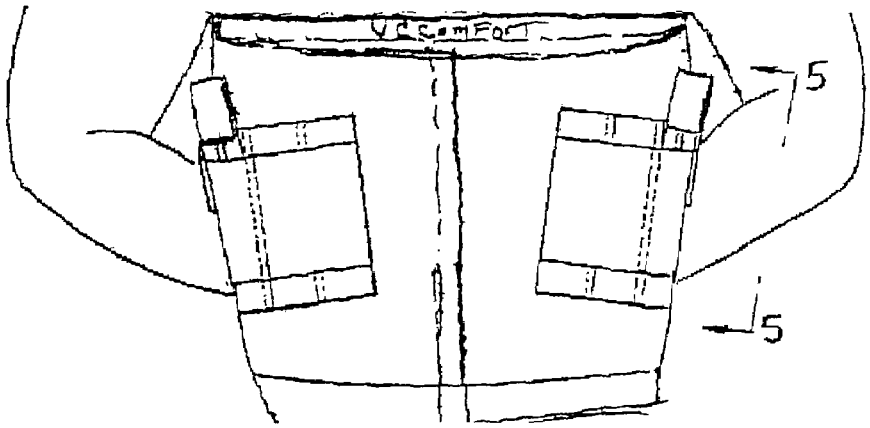

FIG. 14 is a fragmented view of the undergarment compression short on a body with concealed weapons showing that one or more weapons can be concealed along with pockets for handcuffs, ammunitions, mace, (et, al)

DETAILED DESCRIPTION OF THE PREFERRED EMBODIMENTS

Detailed descriptions of the preferred embodiments are provided herein. It is to be understood, however, that the present invention may be embodied in various forms. Various aspects of the invention may be inverted, or changed in reference to specific part shape and detail, part location, or part composition. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
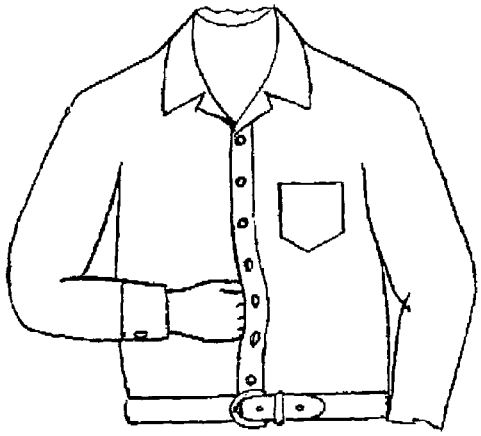
FIG. 1 is a front view of a modified dress shirt worn over an undergarment, showing the wearer pushing his/her hand into the outer shirt to gain access to his/her weapon and or items securely located on his/her upper torso inside the undergarment concealment holster system.

The present invention as see in FIG. 1 comprises of an outer garment which is worn over an under garment concealment holster (FIG. 4) to conceal the fact the wearer is truly armed and concealing an item and or items, FIG. 1 shows wearer attempting to access the located in the undergarment.

Figure 2:
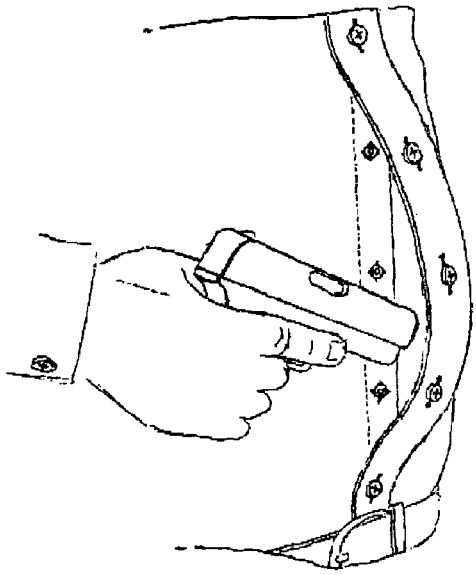
FIG. 2 is a fragmented view of a weapon being drawn from a modified quick snap button and regular stitched on buttons opening of an outer dress shirt.
Figure 4:
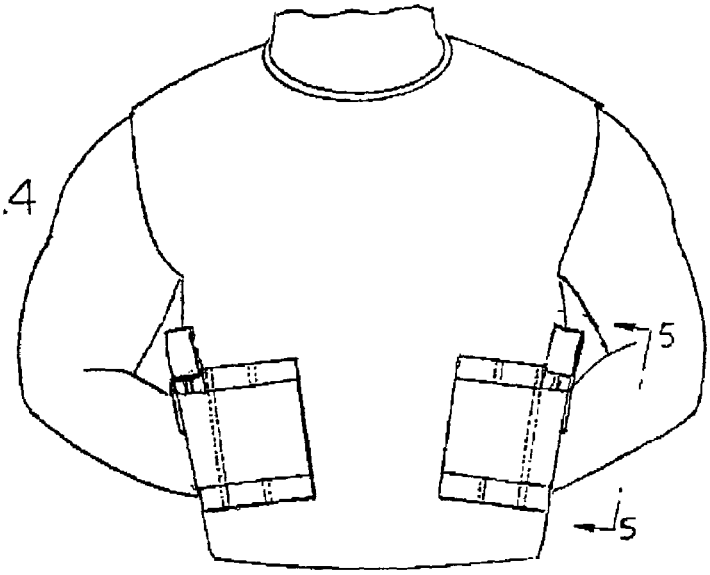
FIG. 4 is a fragmented view of the compression undergarment concealment shirt thereof on a body with concealed weapons showing that one or more weapons can be concealed along with pockets for handcuffs, ammunitions, mace, (et, al)
Figure 5:
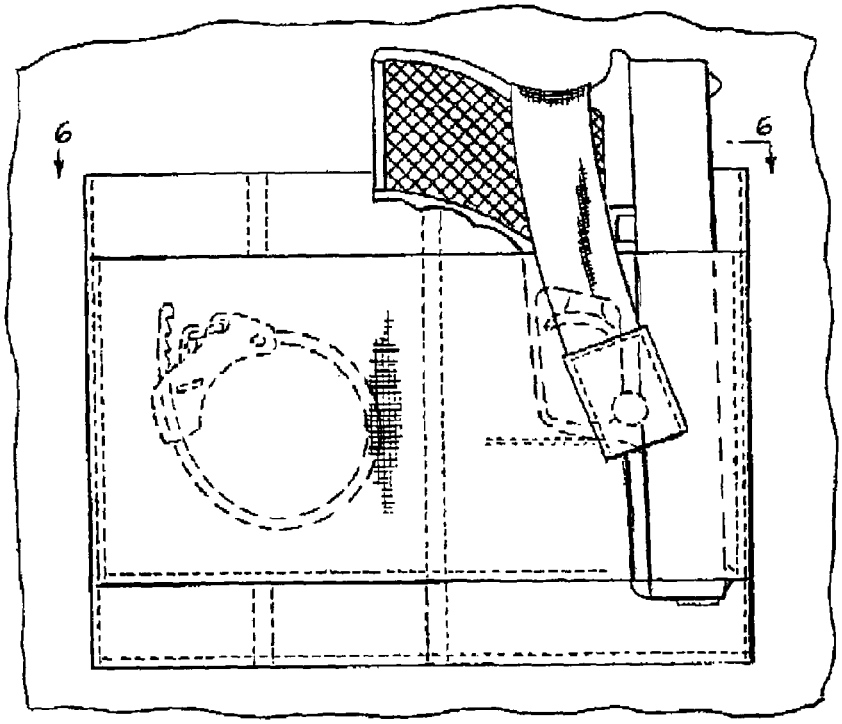
FIG. 5 is a view taken along lines of 5-5 of FIG. 4 showing a weapon releasably held in a holster.
Figure 10:
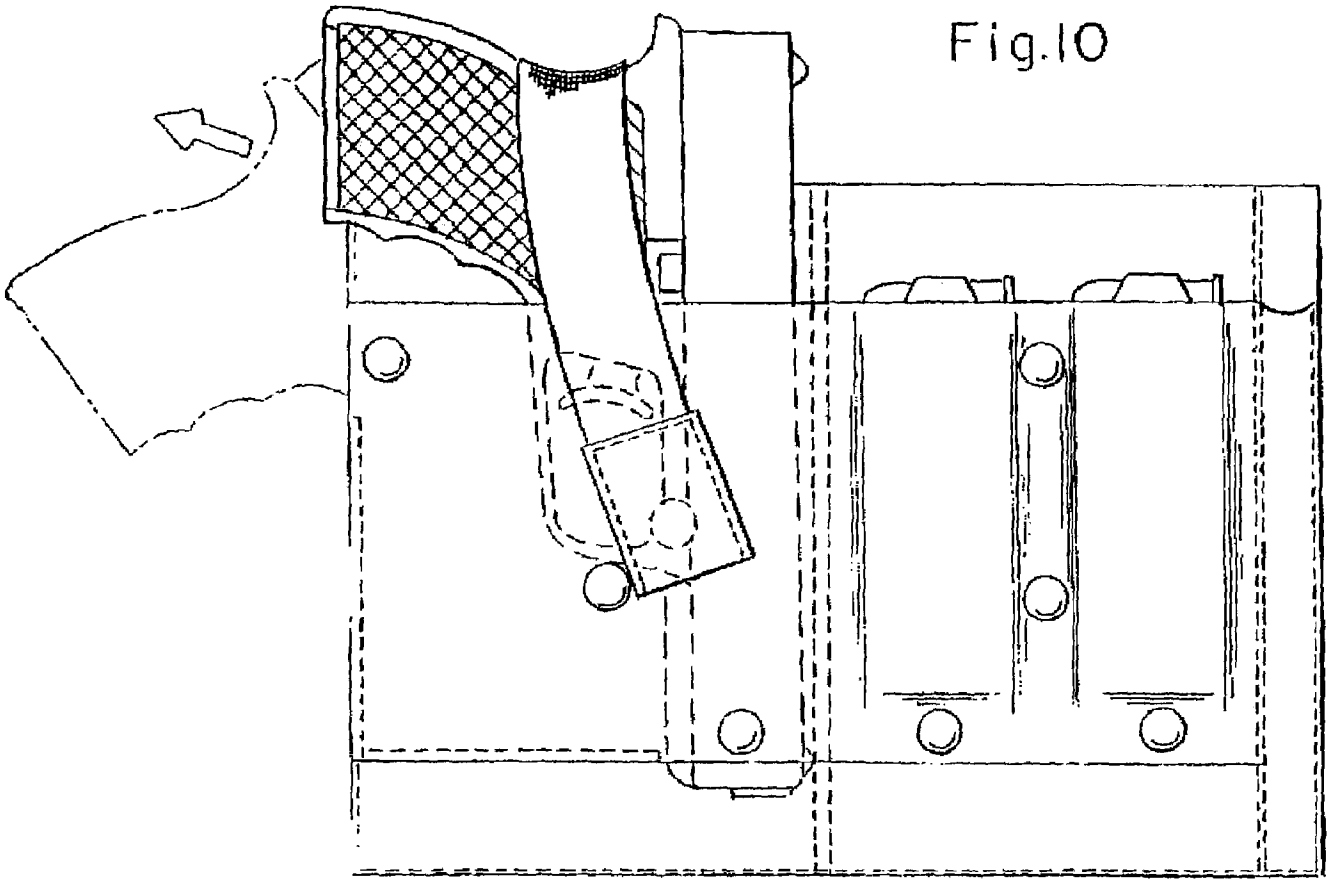
FIG. 10 is a view of the concealment holster/pouch showing the multifunctional aspect of the holster to include holster along with pockets for ammunitions, also showing a side quick snap release and retention, allowing for a side draw, along with quick release safety strap.

Referring now to FIG. 2, the outer garment such as a dress shirts and the like is manufactured with regular buttons and quick snap buttons, which make it easy for the wearer to insert his or her hands through the shirt to access any item such as a handgun, handcuffs or ammunitions located in the holster attached to the undergarment as shown in FIG. 4, FIG. 5 and FIG. 10. With one quick action the wearer will have access to his weapon without having to rip your buttons. In an emergency situation time is essential, seconds count. That is why the outer garment is the essential means to towards gaining access to the under-garment concealment holster system. The outer shirt is also essential because it is used to conceal the undergarment from even the sharpest observer.

Figure 3:
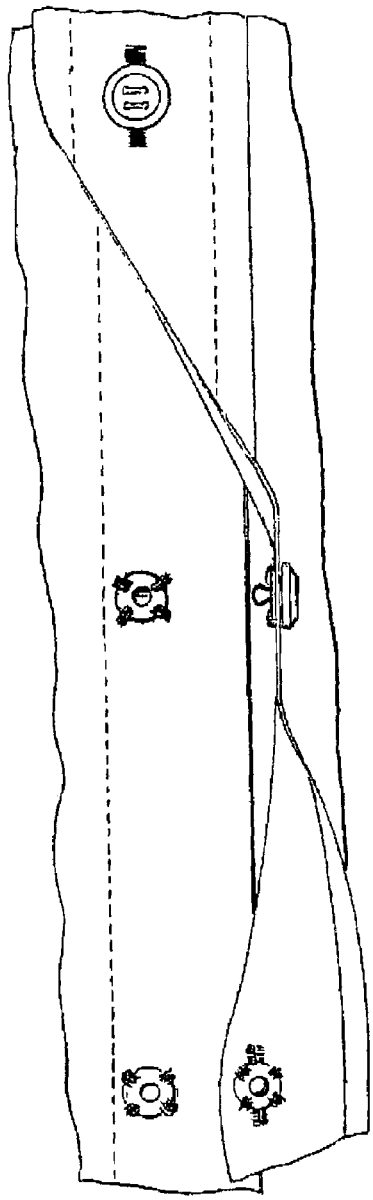
FIG. 3 is a fragmented close up view of the quick snap buttons combined with regular stitched on button opening of the outer dress shirt to be worn over the undergarment holster.

As seen in FIG. 3 access from the outer garment is made possible due the addition of quick snap buttons. The outer shirt is made to look like any other button shirt(s), the to button and or buttons being that of a regular buttons, with the middle two or three buttons on the shirt being that of quick snap buttons and the other buttons preferably are regular shirt non snap buttons.

Figure 8:
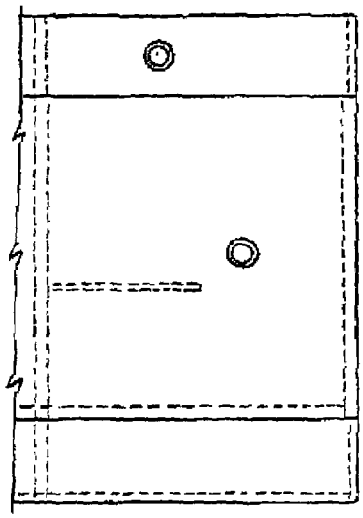
FIG. 8 is a partial view similar to FIG. 7 showing alternate stitching to secure and support a weapon's and or items placed within the holster pouch.
Figure 9:
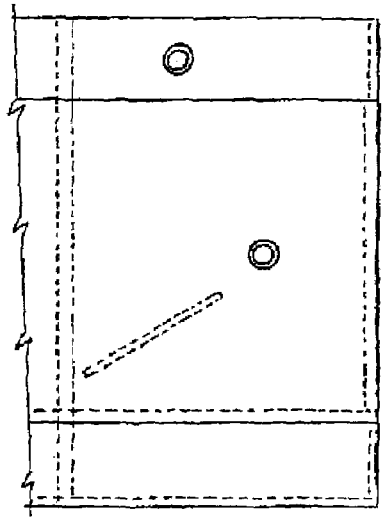
FIG. 9 is a view similar to FIG. 8 with further alternate stitching.

In FIG. 4 it can be see the present invention which comprises of an undergarment compression concealment shirt holster system, on each side of the upper torso under the left and are right arms are there are two holster stitched and or snapped onto the undergarment as shown in FIG. 8, and FIG. 9, allowing for the wearer to wear on each side two handguns one in a frontward position and another in a rear undetectable position, along with handcuffs as shown in FIG. 5, ammunitions as shown in FIG. 1 mace, a small baton et, al. all in comfort. The undergarment is worn on the body under an outer garment as shown in FIG. 1 and quickly accessible from under the outer garment as shown in FIG. 2, fits all small to large frame handguns.

Figure 6:
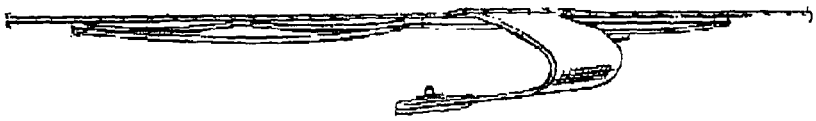
FIG. 6 is view taken along lines 6-6 of FIG. 5 said weapon to show available pockets.

FIG. 5 is a view taken along lines 5-5 of FIG. 4 showing a weapon releasably held in a holster, FIG. 5 also shown is view of the holster being converted from a holster that carries a weapon to a holster hand cuff carrying case as well as the additional available pockets FIG. 6.

Figure 7:
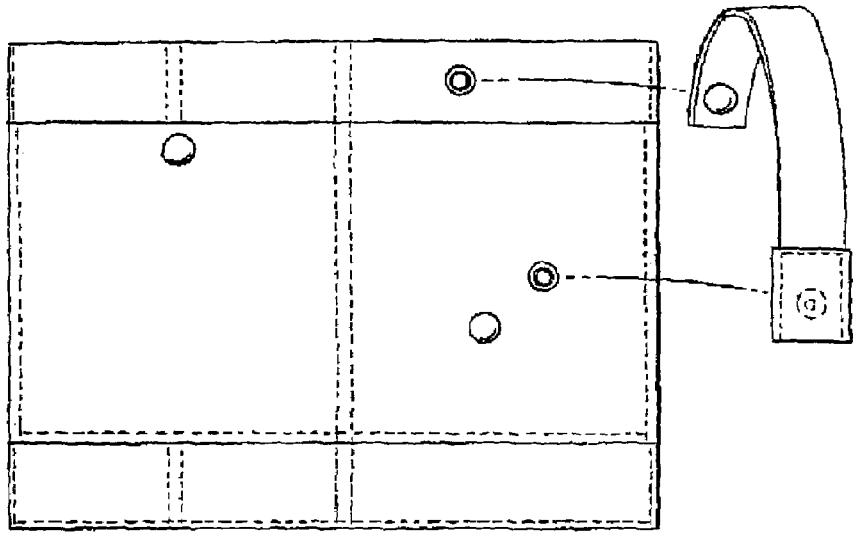
FIG. 7 is a view of a holster carrier combination with snap-retention and quick snap release closures to be located on upper and lower torso of the undergarment holster system and it releasable mode.

FIG. 7 shows a holster carrier made of on elastic fabric or other malleable material, in FIG. 7 see the various quick snap aspect of the holster is shown. The safety strap is made with snaps at the two ends when connected one snap is connected to the body of the undergarment and the end is connected to the holster outer body, with the safety strap connected at both end the wearer in the event of emergency will simply pull the weapon out either upwards, and or a sideward/downward motion FIG. 10 and the snaps will disengage allowing for the quick release and quick access of the weapon, there is no need to first unsnap, this concealment apparatus having a safety straps integrated with a quick release mechanism to keep all items in place and resist inadvertent removal and or slipping out of the holster/pouch, until removed by the wearer of the apparatus FIG. 7 also show snap located on the bottom, the bottom allow for the holster to be closed and used, as a closed pouch's forming multiple pockets FIG. 10. One par of the snaps preferably the male part is permanently secure to the undergarment which provides an added strength for the support of the items being placed inside the holster/pouch pockets and acts as secondary support to the stitching which is used to hold a weapon and or other items such as a radio, cell phone wallet, FIG. 8, FIG. 9.

Referring now to FIGS. 11, 12, and 13, the outer garment such as a shorts/pants side seam or (false) pocket and the like is manufactured with a quick snap buttons and or Velcro hook and loop fasteners, which make it easy for the wearer to insert his or her hands through the side seam and or pocket to access any item such as a handgun, handcuffs or ammunitions located in the holster attached to the undergarment as show in FIG. 10, FIG. 14 and FIG. 15. With one quick action the wearer will have access to his weapon without having to rip pull down his or her pants. In an emergency situation time is essential, seconds count. That is why the outer garment is the essential means to towards gaining access to the under-garment concealment holster system. The outer short/pants is also essential because it is used to conceal the undergarment from even the sharpest observer.

In FIG. 14 it can be see the present invention which comprises of an undergarment compression concealment short holster system, on each side of the lower torso the left and are right upper legs are there are two holster stitched and or snapped onto the undergarment as shown in FIG. 8, and FIG. 9, allowing for the wearer to wear on each side two handguns one in a frontward position and another in a rear undetectable position, along with handcuffs as shown in FIG. 5, ammunitions as shown in FIG. 10 mace, a small baton (et, al) all in comfort. The garment when fully loaded is held up vi a belt on the waist. The undergarment is worn on the body under an outer garment a shown in FIG. 11 and quickly accessible from under the outer garment as shown in FIG. 12, FIG. 13, fits all small to large frame handguns.

While the invention has been described in connection with a preferred embodiment, it is not intended to limit the scope of the invention to the particular form set forth, but on the contrary, it is intended to cover such alternatives, modifications, and equivalents as ma be included within the spirit and scope of the invention as defined by the appended claims.

The invention claimed is:

1. A universal compression undergarment concealment holster apparatus worn under a users clothing, for the concealment and simultaneous carry of more than two weapons and other items, and the process that permits for said weapons and other items located in said apparatus to be safely carried and quickly drawn from the users outer clothing from over 12 conventional modes on the human body (under the arm on either side thereof, on the chest thereof, on either leg thereof, on the back thereof, on either waist thereof), without the need of special or additional fixtures, said concealment apparatus having safety straps integrated with a quick release mechanism to keep said items in place and resist inadvertent removal or slipping out of said holster apparatus, until removed by the user, said apparatus comprising:

a holster body connected to a concealable undergarment having elongated fastenable receiving pockets extended along its length and releasably opened at least at one end or both for inserting and securing a weapon or other items placed in said releasable holster pockets; an elongated material stronger or equal to that used in manufacturing of the undergarment body, forming that of the holster body, having two or more spaced detachable and convertible pockets for allowing a variety of items varying in sizes within the holster body to be carried;

a compression undergarment concealment shirt holster with a quick release and detachable gun retention device; said holster shirt apparatus made of a soft material with a snap fastener retention device for applying pressure to a handgun in the holster to resist inadvertent removal of a handgun or other items located in said holster; a handgun retention strap is releasably secured to the undergarment and the holster; wherein said fastener comprises a releasable fastener mechanism for releasably securing and removing said weapon or other items into the holster body; said holster shirt apparatus covering a majority of the upper body; said holster shirt apparatus providing multiple modes to carry a weapon and other items in a concealed manner, removably securing a weapon to the upper body having an opening and removably retaining fully loaded hand guns under either arm, chest, lower back, and waist of a user; said apparatus includes integral holsters stitched and fastened using alternative fasteners to secure said holsters to the compression undergarment having receiving pockets; said holsters combined to the compression undergarment having receiving pockets, said pockets capable of being used to carry a weapon (handguns of various brands, styles, sizes, and shapes) and other items, not limited to handcuffs, extra ammunition and the like; said garment also having interior and exterior pouches for the insert of ballistic panel batons, flashlights, knives, gloves, cellular telephones, radios, pens, and other similar items simultaneously under each arm or on other various locations undetected on the upper torso of the body;

a compression concealment undergarment shirt which includes integral holsters stitched and fastened using alternative fasteners to secure said holsters to the compression undergarment having multiple receiving pockets per side, said pockets having a detachable and releasable center core locking mechanism to support the weapon, alternatively said mechanism can be stitched horizontally, in circular, or Z shape, or releasably snap fastened; said holsters having receiving pockets having a releasable fastening mode comprising hook and loop fastener, snap fasteners, or other alternative detachable fastening modes, to allow for the detachable closures of the top and bottom opening of the holster pockets; said pockets partially stitched and detachable with a snap closure to allow for a side release or draw of a weapon from said holster; one location allowing for a frontal upward draw or release of a weapon; one said location allowing for frontal downward draw or release of a weapon; one said location allowing for a rear upward draw or release of a weapon; one said location allowing for a rear downward draw or release of a weapon; said pockets capable of being transformed to carry other items such as handcuffs, gloves, extra ammunition, without sagging from the weight of a fully loaded weapon and the weight of other items in said holster; said undergarment manufactured with a stretchable aramid or para-aramid fibers, fiber reinforced polymers and the like which protect the wearer against sudden unexpected attacks by a blunt trauma object or projectile, and capable of protecting its user from cuts and slashes; wherein said material is fire retardant;

a combined concealment undergarment shirt holster system and outer garment shirt with quick access detachable fasteners featuring a resilient material manufactured to form a wearable outer garment worn over the undergarment compression shirt holster system; said outer garment having an opening at a central point within its length to allow quick unobtrusive access to a weapon or items located inside the undergarment holster; said outer garment comprising releasable fasteners in the form of hook and loop fasteners, snap fasteners, or other alternative detachable fastening modes that are comfortable and convenient for the wearer; the outer garment conceals the weapon(s) from view in a secure manner, while the weapon(s) are in an accessible location on the body unknown to a careful observer.

* * * * *